US006601353B2

(12) United States Patent
Gabriele

(10) Patent No.: US 6,601,353 B2
(45) Date of Patent: Aug. 5, 2003

(54) ADJUSTABLE SHUTTER LEVEL

(75) Inventor: Angelo Gabriele, Concord (CA)

(73) Assignee: Vinylbilt Shutter Systems Inc., Concord (CA)

( * ) Notice: Subject to any disclaimer, the term of this patent is extended or adjusted under 35 U.S.C. 154(b) by 18 days.

(21) Appl. No.: 09/985,508

(22) Filed: Nov. 5, 2001

(65) Prior Publication Data

US 2002/0194800 A1 Dec. 26, 2002

(51) Int. Cl.[7] ..... E06B 3/26

(52) U.S. Cl. ..... 52/202; 52/126.4; 49/394; 292/DIG. 15; 248/188.4

(58) Field of Search ..... 52/202, 126.1, 52/126.3, 126.4, 126.7; 49/394, 504, 505; 292/DIG. 15; 312/334.16, 334.36; 248/188.4; 160/210, 213, 206; 16/DIG. 6, DIG. 17

(56) References Cited

U.S. PATENT DOCUMENTS

| | | | | | |
|---|---|---|---|---|---|
| 1,973,948 | A | * | 9/1934 | Fogelstrom | 248/188.4 |
| 3,100,099 | A | * | 8/1963 | Schaefer | 248/188.4 |
| 4,996,811 | A | * | 3/1991 | Dull et al. | 52/241 |
| 6,407,351 | B1 | * | 6/2002 | Meyer et al. | 177/238 |

FOREIGN PATENT DOCUMENTS

| | | | | |
|---|---|---|---|---|
| JP | 08158605 A | * | 6/1996 | 49/504 |

* cited by examiner

*Primary Examiner*—Carl D. Friedman
*Assistant Examiner*—Naoko Slack

(57) ABSTRACT

A plastic shutter level is formed by a cap assembly which fits into the bottom of a vertical stile of the shutter. The cap assembly includes a cap body and an adjustable member which threads into the cap body. The adjustable member has a cam shaped bottom face which cams over the shutter frame to provide an automatic leveling adjustment of the shutter when in its closed position.

3 Claims, 3 Drawing Sheets

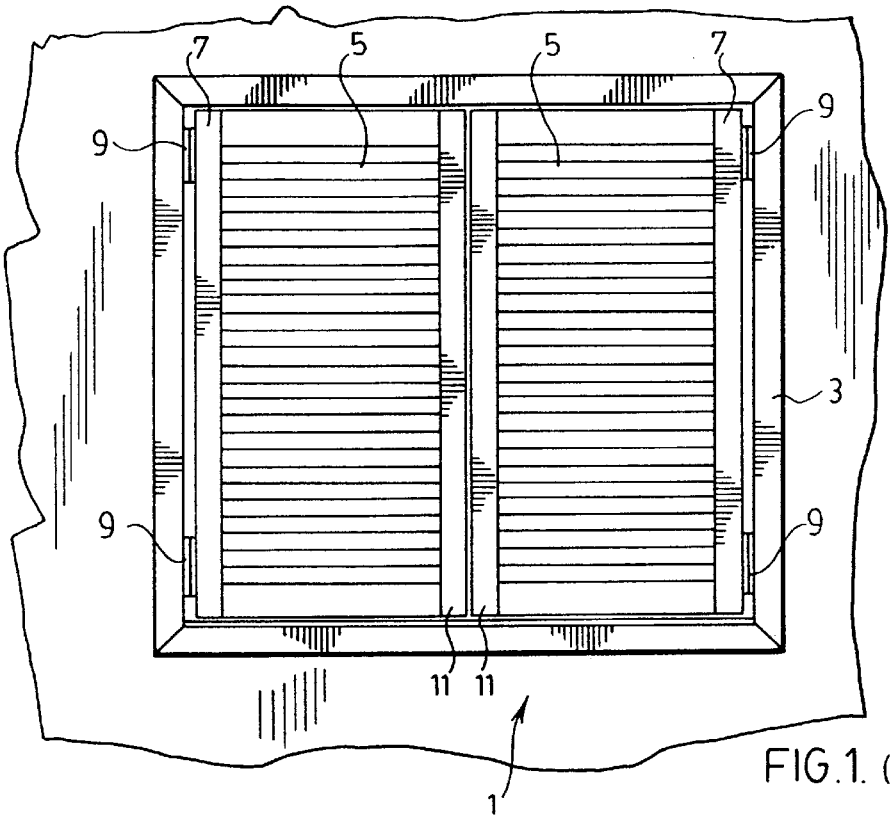
FIG.1. (PRIOR ART)
FIG.2. (PRIOR ART)
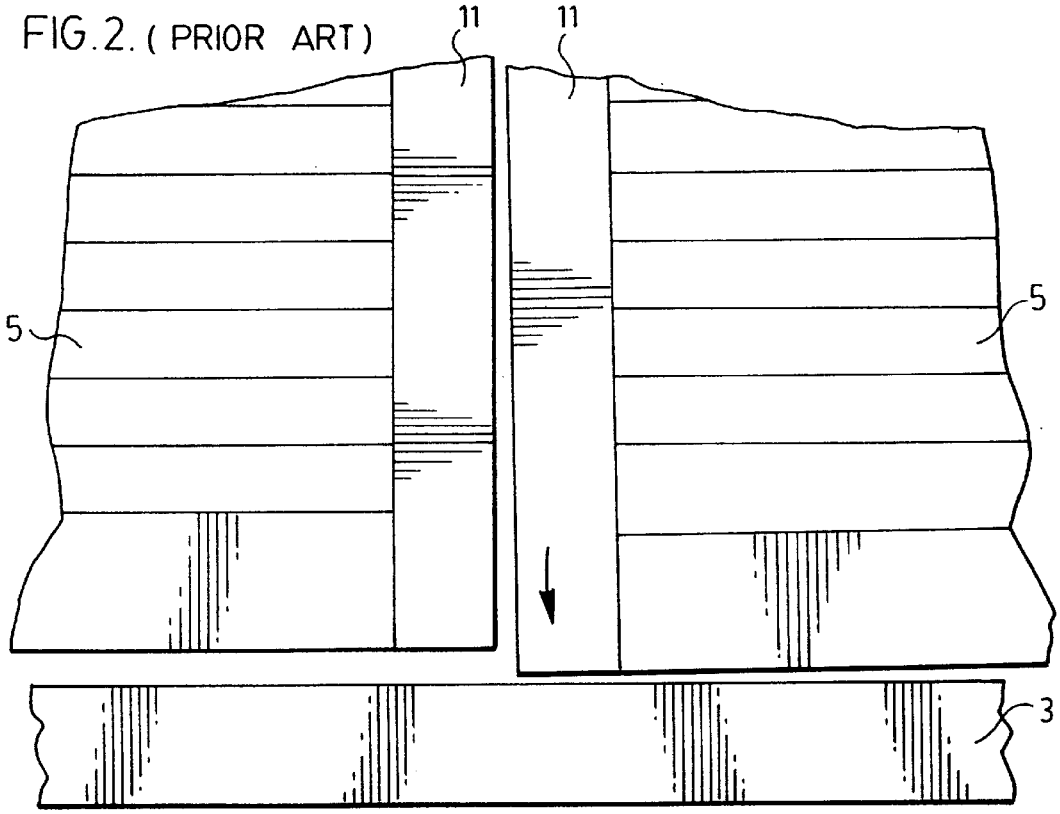

23
27
29
31
21
25

37
39
41
35
43
53
57
55
33
59
51
61

47
45
23

59
35
3

ADJUSTABLE SHUTTER LEVEL

FIELD OF THE INVENTION

The present invention relates to shutters which swing between an open and a closed position at a window to be covered by the shutters. In particular, the invention relates to means to level the shutters when they are swung to a closed position.

BACKGROUND OF THE INVENTION

Window covering shutters are becoming more and more popular. A particularly desirable type of shutter is one which hinges open and closed relative to the window and which often includes movable louvers for varying degrees of privacy when the shutter is in the closed position.

The above types of shutters have been available for many years in a wooden construction. More recently they have become available with a plastic construction.

These swinging shutters have laterally displaced vertical stiles including a first stile which is hingedly secured to the shutter frame and a second stile located at the free edge of the shutter which swings away from and back into the shutter frame as the shutter is being opened and closed.

It is often difficult to hang this shutter such that it closes in a level position i.e., a position where it is properly aligned with the frame. Typically the second stile along the free edge of the shutter will have a tendency to drop downwardly relative to the more fixed first stile. The problem increases over time with use of the shutter hinges.

The problem of an improperly leveled shutter is particularly noticeable when the window covering includes a pair of side by side shutters which swing open and close relative to one another.

SUMMARY OF THE PRESENT INVENTION

The present invention provides an end cap assembly to be inserted at the base of a vertical stile of a swinging window shutter to provide an adjustable leveling of the shutter.

More particularly, the end cap assembly of the present invention comprises a cap body which fits into the lower end of the stile and a screw member which threads to different settings into the cap body. The screw member has a head portion which protrudes from the cap body and which has a cam shaped bottom face to cam over a leveling surface i.e., a shutter frame below the vertical stile of the shutter.

According to an aspect of the invention the end cap assembly including both the cap body and the threaded member are made from a plastic material to be used in a plastic window shutter.

BRIEF DESCRIPTION OF THE DRAWINGS

The above as well as other advantages and features of the present invention will be described in greater detail according to the preferred embodiments of the present invention in which;

FIG. 1 is front view of a prior art shutter assembly;

FIG. 2 is an enlarged view of the lower center region of the prior art shutter of FIG. 1;

DETAILED DESCRIPTION ACCORDING TO THE PREFERRED

Figure 3:
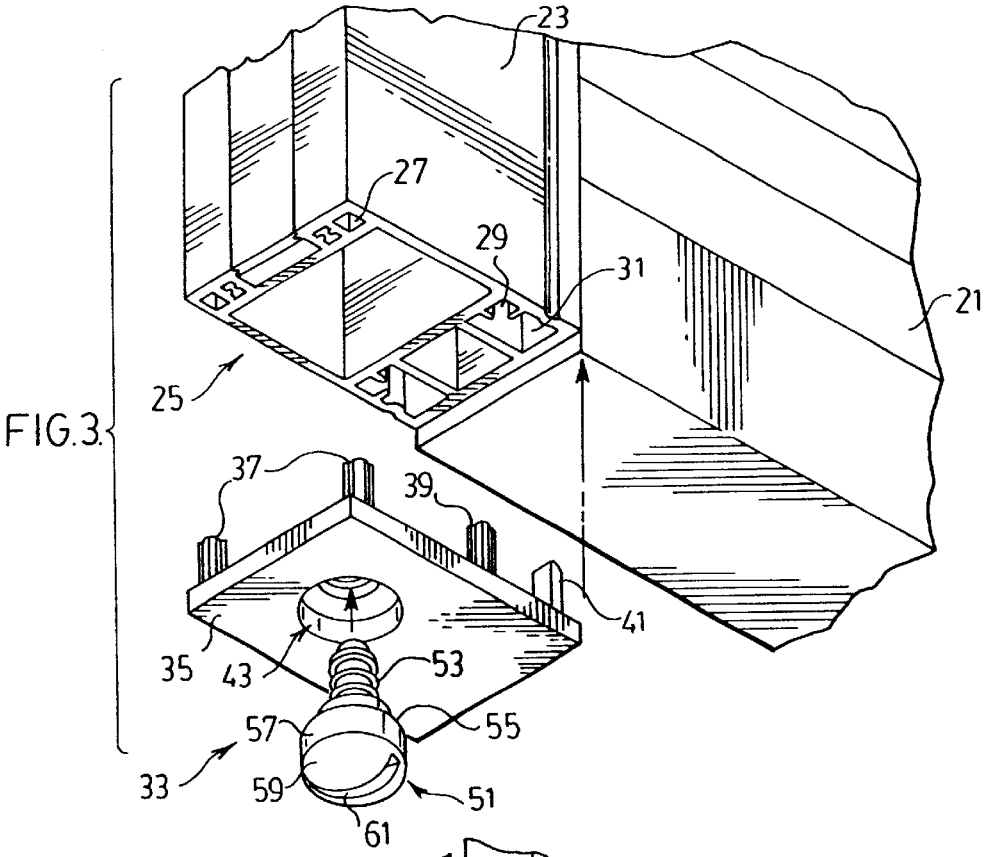
FIG. 3 is a bottom perspective view of a shutter stile and a bottom cap level adjustment to fit in the stile in accordance with a preferred embodiment of the present invention.

EMBODIMENTS OF THE PRESENT INVENTION IN WHICH:

FIG. 1 shows a prior art shutter assembly generally indicated at 1. This shutter assembly comprises a pair of swinging shutter members 5 and a supporting frame 3 for the shutter members. Each shutter member has an outside edge vertical stile 7 which is hingedly secured at 9 to the frame. Further provided in each shutter member is an inside or free edge vertical stile 11 which swings away from the frame to an open shutter position and then back into the frame as shown in FIG. 1 to a closed shutter position.

Each of the shutters 5 may have a fixed or a moveable louver construction.

FIG. 2 shows the problem typically encountered with prior art shutters i.e., the right side shutter does not properly hang in a level position from the shutter frame. As a result, it will be seen that the vertical stile 11 of the right side shutter drops down much closer to the sill of the frame 3 than the left side shutter. From an esthetic standpoint this is very noticeable when the two shutters are closed and from a functional standpoint the fact that either one or both of the shutters may be non level can cause them to jamb against the frame or against one another making it difficult to close either one or both of the shutters.

FIG. 3 of the drawings shows the interior edge stile 23 of a shutter 21 fitted in accordance with the present invention with a bottom cap assembly generally indicated at 33 to provide for adjustable leveling of shutter 21.

Cap assembly 33 comprises a main flat cap body 35 provided with a plurality of legs 37, 39 and 41 which are perpendicular to the cap body 35.

Shutter 21 preferably has a plastic construction and stile 23 is formed as a generally hollow extrusion. The extrusion is cut to an appropriate length for the shutter leaving it with an open end 25. This open end is bordered by a plurality of plug receptor insertion regions 27, 29 and 31. The legs 37, 39 and 41 of cap body 35 push into these insertion regions to fictionally secure the cap over the open bottom end of the stile.

It is to be noted that the length of the stile is cut such that it is slightly shorter than the bottom of the sill of the frame as can be seen in FIG. 3 of the drawings. Accordingly, the cap body 35 once fitted into position aligns flushly with the bottom of the frame. This is well shown for example in FIG. 6 of the drawings.

The cap body 35 includes a multiple stage opening generally indicated at 43 in FIG. 3. As better seen in FIGS. 5 and 6 this multiple stage opening includes a first opening region 45 and a second opening region 47 which is smaller than and therefore stepped inwardly relative to the opening region 45. Opening region 45 is bordered by a flat sidewall 46 whereas the opening region 47 is bordered by a threaded sidewall 48. Again this is best shown in FIG. 6 of the drawings.

End cap assembly 33 further includes a threaded screw like member generally indicated at 51. Member 51 has a threaded stem 53 which threads with the sidewall 48 of opening region 47. This provides a threaded adjustment between threaded member 51 and cap body 35.

The head 55 of the threaded member has a flat sidewall 57 and a convex bottom face 59. A tool receiving opening such as slot 61 is provided in the bottom face of the head of the threaded member.

Figure 6:
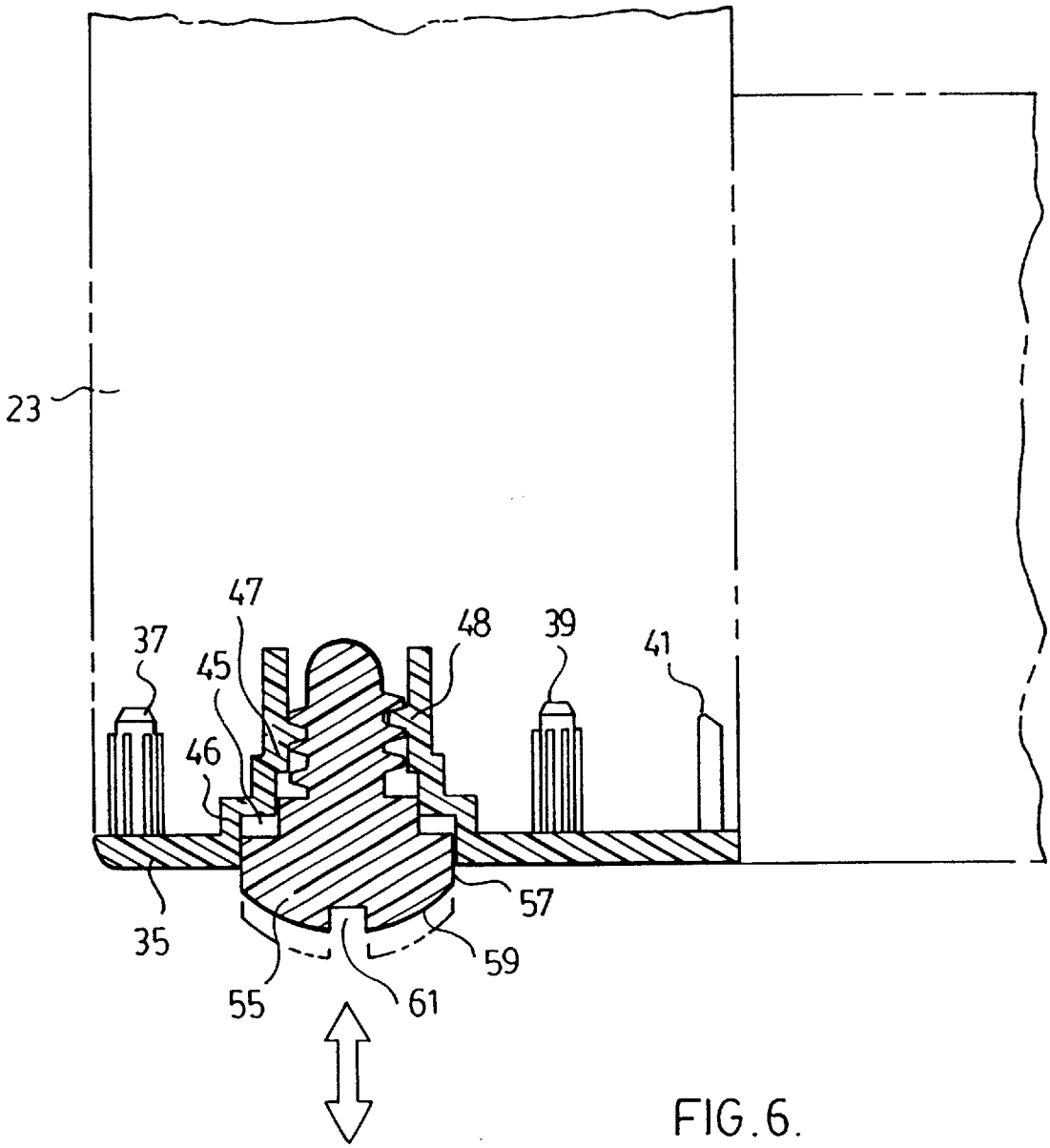
FIG. 6 is a sectional view through the bottom cap level adjustment in the shutter of FIG. 5.

Also well shown in FIG. 6 of the drawings, with the shaft of member 51 threaded into opening region 47, the sidewall 57 of the head of the threaded member nests within opening region 45 against the flat sidewall 46 of that opening region. The fit between the two flat walls 46 and 57 is sufficiently close to essentially eliminate any play between the threaded member and the cap while at the same time allowing the threaded member to be easily adjusted relative to the cap.

It is also to be noted that even in the fully inserted i.e., upwardly adjusted position of the threaded member its bottom face 59 protrudes downwardly from the cap body 35. This ensures that the bottom edge of the shutter will never sit directly against the sill of the frame.

Like the rest of the shutter the end cap assembly including both the cap body and the threaded member are preferably made from a plastic material. This plastic material matches up with the remainder of the shutter and therefore does not detract from the esthetic appeal of the shutter. In addition, the plastic construction of the threaded member adds the benefit that the threaded member will not scratch or mark the shutter frame when the shutter is closed as described below.

Figure 4:
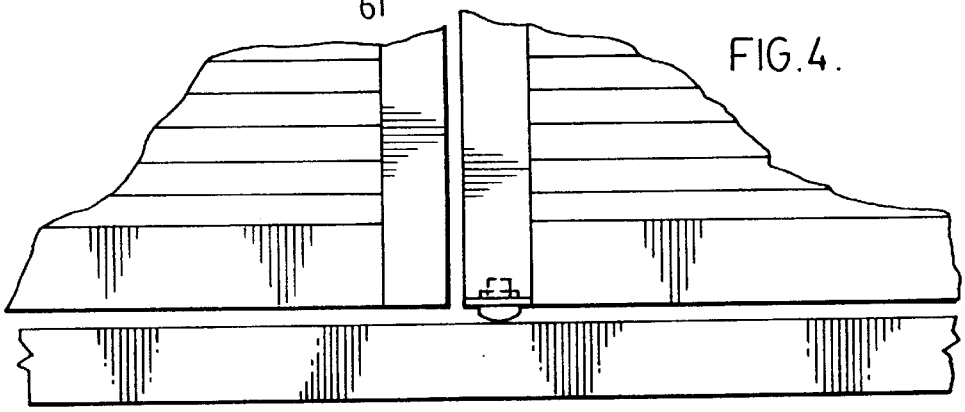
FIG. 4 is a front view of a shutter assembly with one of the shutters fitted with the bottom cap level adjustment of FIG. 3 and with the shutter in the closed position.
Figure 5:
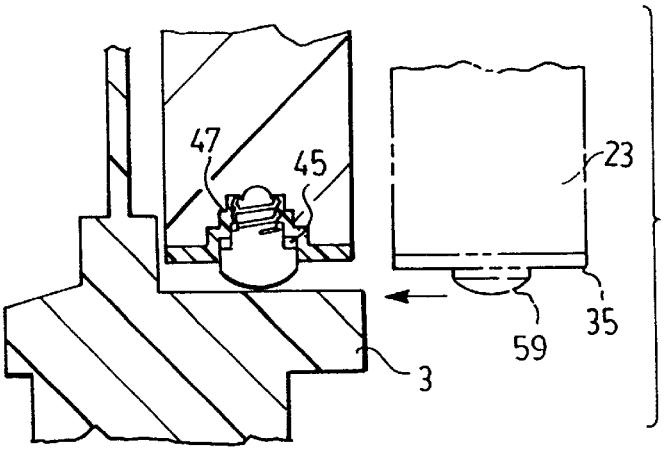
FIG. 5 is an end view of the leveled shutter of FIG. 4.

FIG. 5 of the drawings shows the shutter in dotted lines in a slightly open position and in solid lines in a completely closed position. In comparing these two positions it will be seen that the stile 23 of the shutter is dropped slightly in the open position relative to the closed position. As the shutter is pushed to the closed position the convex bottom face of the threaded member cams over the upper surface of the sill of the frame 3 to lift the stile 23 of the shutter. FIG. 4 of the drawings shows that with the shutter lifted to the FIG. 5 position the left and right hand shutters are completely level with one another along their bottom edges. This also provides proper vertical alignment between the two shutters.

As will be appreciated the threaded member 51 is easily adjusted according to the amount of misalignment there may be between the two shutters. Furthermore, unlike the setup in FIG. 4 of the drawings each of the shutters may be provided with its own adjustment. This allows independent shutter adjustment to assure a leveling of the shutters relative to one another with proper alignment of the shutters relative to the surrounding shutter frame.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A shutter to be hingedly mounted for swinging open and closed relative to a surrounding shutter frame, said shutter having a first vertical stile which is a frame mounting stile and a second vertical stile along a free edge of said shutter spaced laterally of said shutter from said first stile, said second stile having a bottom cap assembly which provides a level adjustment of said shutter when in a closed position, said bottom cap assembly comprising a cap body and a screw member which threads to different settings in said cap body, said screw member having a head portion which protrudes from said cap body and which has a cam shaped bottom surface.

2. A shutter as claimed in claim 1 having a plastic material construction, said second vertical stile having an open lower end with plug receptors, said cap body comprising a flat cap portion with legs which are perpendicular to said cap body and which are plugged into said plug receptors of said lower end of said second vertical stile.

3. A window shutter assembly comprising a shutter frame and a pair of shutters which swing between an open and a closed position on said frame, each of said shutters having an outer edge vertical stile which is hingedly mounted to said frame and an interior edge vertical stile spaced laterally from the outer edge vertical stile, the interior edge vertical stile of at least one of said shutters having a bottom cap assembly to provide an adjustable leveling of the one shutter, said bottom cap assembly comprising a cap body and a screw member which threads to different settings in said cap body, said screw member having a head portion which protrudes from said cap body and which has a cam shaped bottom face, said window shutter assembly having a plastic construction and the cap body of the bottom cap assembly being plugged into the interior edge vertical stile of the one shutter, the threaded member of the cap assembly having a protruding bottom face which cams over the shutter frame which adjusts leveling of the one shutter when in the closed position.

* * * * *